United States Patent [19]

Janutta et al.

[11] 4,406,275

[45] Sep. 27, 1983

[54] APPARATUS FOR DRESSING AND PROFILING GRINDING WHEELS

[75] Inventors: Reinhard Janutta, Heide; Wolfgang Eggert, Glinde, both of Fed. Rep. of Germany

[73] Assignee: Hauni-Werke Körber & Co. KG., Hamburg, Fed. Rep. of Germany

[21] Appl. No.: 394,469

[22] Filed: Jul. 1, 1982

Related U.S. Application Data

[63] Continuation of Ser. No. 245,985, Mar. 20, 1981, which is a continuation of Ser. No. 62,296, Jul. 31, 1979, abandoned.

[30] Foreign Application Priority Data

Jul. 31, 1978 [DE] Fed. Rep. of Germany ..... 2833625

[51] Int. Cl.[3] ..... B24B 53/06

[52] U.S. Cl. ..... 125/11 CD

[58] Field of Search ..... 125/11 CD, 11 R, 11 AS

[56] References Cited

U.S. PATENT DOCUMENTS

| | | | |
|---|---|---|---|
| 2,347,283 | 4/1944 | Ross | 125/11 CD |
| 2,350,897 | 6/1944 | Jellis | 125/11 CD |
| 2,422,220 | 6/1947 | Brocker | 125/11 CD |
| 2,535,183 | 12/1950 | Wilson | 125/11 CD |
| 2,571,293 | 10/1951 | Ross | 125/11 CD |
| 3,581,730 | 6/1971 | Boyd | 125/11 CD |
| 3,747,584 | 7/1973 | Kikuchi | 125/11 CD |
| 3,855,992 | 12/1974 | Nordin | 125/11 CD |

FOREIGN PATENT DOCUMENTS

| | | | |
|---|---|---|---|
| 228445 | of 1925 | United Kingdom | 125/11 AS |

*Primary Examiner*—Harold D. Whitehead

*Attorney, Agent, or Firm*—Kontler, Grimes & Battersby

[57] ABSTRACT

An arrangement for dressing, profiling or otherwise treating the peripheral surface of a grinding wheel or the like includes a dressing disk which is mounted on a support for rotation about a given axis and has a peripheral surface which contacts and treats the peripheral surface of the grinding wheel during the operation of this arrangement. The dressing disk is also mounted for angular displacement about a pivot axis which intersects the treating surface at the point of contact with the grinding wheel, and also the axis of rotation of the dressing disk. The axis of rotation and the pivot axis of the grinding wheel make an angle of about 1° in each of two positions which the dressing disk assumes relative to the grinding wheel during the operation of the arrangement. The dressing disk may be symmetrical or, preferably, asymmetrical as considered in a radial plane of the dressing disk. The treating surface may have an inner end which is located at the point of intersection of the pivot axis with the peripheral surface of the dressing disk.

10 Claims, 4 Drawing Figures

APPARATUS FOR DRESSING AND PROFILING GRINDING WHEELS

This application is a continuation of application Ser. No. 245,985, filed Mar. 20, 1981, which is a continuation of Ser. No. 062,296, filed July 31, 1979, now abandoned.

BACKGROUND OF THE INVENTION

The present invention relates to grinding machines in general, and more particularly to improvements in the construction and mounting of dressing and/or profiling tools for the working surfaces of grinding wheels in such machines. Still more particularly, the invention relates to improvements in grinding machines wherein a rotary dressing tool is movable between several positions in order to treat (namely, dress and/or shape) different portions of the working surface of a grinding wheel.

It is already known to treat a working surface which exhibits circumferentially extending grooves and/or ridges by resorting to a rotary dressing tool whose orientation with respect to the grinding wheel can be changed so that the tool can treat, in several stages, different portions of the working surface. The material removing surface of the dressing tool need not conform to the working surface. The tool is a relatively thin disk, especially if the working surface of the grinding wheel is formed with narrow and/or deep circumferential grooves. As a rule, the periphery of the dressing tool is caused to travel along one or more paths so as to form an envelope curve corresponding to the desired profile of the working surface of the grinding wheel.

German Offenlegungsschrift No. 2,510,558 discloses a grinding machine wherein the dressing disk can be moved to a plurality of different positions with respect to the grinding wheel. This enables the dressing disk to treat several discrete portions of the working surface, namely, portions which are disposed in different planes and are inclined with respect to each other. To this end, the dressing disk is movable about an axis which extends parallel to the tangential direction of the dressing disk and coincides with the center of curvature of a portion of the usually convex peripheral surface of the dressing disk. Thus, the pivot axis of the disk is immediately adjacent to the working surface because the radius of curvature of the peripheral surface of the dressing disk is relatively small. This enables an attendent to pivot the flat disk-shaped dressing tool in which a way that a point on the radius of this tool engages the working surface while the dressing tool pivots, and such pivoting does not result in undesirable collision of the grinding wheel with other portions of the tool, namely, with portions other than that including the peripheral surface.

A drawback of the just described prior proposal is that the means for mounting and moving the dressing tool are quite complex, bulky and expensive. Moreover, the stability of the dressing tool in each of its positions is unsatisfactory, mainly because it is rather difficult to kinematically define the pivot axis for the tool in such a way that those portions of the tool which are remote from its peripheral surface do not collide with the grinding wheel during movement of the tool between several positions.

OBJECTS AND SUMMARY OF THE INVENTION

An object of the invention is to provide a grinding machine wherein the means for moving the dressing tool between a plurality of preferred positions is constructed and assembled in a novel and improved way so as to constitute a compact, stable and relatively simple structure.

Another object of the invention is to provide a grinding machine wherein the dressing tool can be securely held in each of its preferred positions and is capable of treating complex working surfaces of grinding wheels.

A further object of the invention is to provide a grinding machine wherein the means for mounting the mobile dressing tool is not only simpler and less expensive but also more reliable and more accurate than in heretofore known grinding machines which utilize adjustable dressing tools.

An additional object of the invention is to provide novel and improved means for moving the dressing tool relative to the grinding wheel and/or vice versa.

Another object of the invention is to provide a dressing tool and mounting means therefor which can be installed in several types of known and/or existing grinding machines.

In pursuance of these objects and others which will become apparent hereafter, one feature of the present invention resides, briefly stated, in an arrangement for treating (dressing and/or profiling) grinding wheels and the like, which comprises a dressing tool having a treating surface contacting the grinding wheel during the treatment of the latter; and means for mounting the dressing tool for angular displacement relative to the grinding wheel about a pivot axis which intersects the treating surface. Advantageously, the pivot axis is located in a plane which is normal to the axis of the grinding wheel, and the dressing tool is disk shaped and is also mounted by the mounting means for rotation about an axis which intersects the aforementioned pivot axis.

This construction has the advantage that it renders it possible to locate the mounting means for the dressing tool relatively far away from the grinding wheel, and yet to achieve displacement of the dressing tool about a point located in close proximity of the grinding wheel. As a result of this, the mounting means has a high degree of stability and resistance to vibrations or oscillations, unlike that of the above-discussed prior art structures where the dressing tool is mounted on mounting means which, in turn, is mounted for pivoting about the same axis as the peripheral portion of the dressing tool, and extending parallel to the tangential direction of the grinding wheel. Because of the resistance to vibrations and oscillations, the mounting means and the dressing tool of the present invention cooperate to obtain a very accurate mode of operation. Simultaneously, the advantage of the prior art which resides in the fact that there is no overlap of or gap between the zones which are treated by the dressing tool in various positions thereof, without having to adjust the position of the dressing tool relative to the grinding wheel (by advancing or returning the dressing tool to compensate for the gaps or overlaps), is retained.

The principle of the present invention can be utilized in grinding machines of various constructions. In the present application, the treating arrangement of the invention will be described as employed in a plunge-cut peripheral grinding machine. However, it will be appreciated that such arrangement can also be used, without substantial modifications, in grinding machines of other types, such as bevel grinding machines, or circular grinding machines.

According to an advantageous feature of the present invention, the mounting means so mounts the dressing tool that the latter can become displaced through at least 180 degrees about the pivot axis, to assume one or the other of two treating positions relative to the grinding wheel. Then, the treating surface, which is preferably convex, has an inner end thereof located at the intersection of the pivot axis with the periphery of the dressing tool. As a result of this configuration of the treating surface and mounting of the dressing tool, it is achieved that successive treatment zones of the surface of the grinding wheel can be treated by the treating surface of the dressing tool without overlaps of or gaps between these successive zones, even though, because of the configuration of the surface to be treated, especially the inclination of the faces which bound grooves or the like in the surface to be treated, it is necessary to switch the dressing tool between the two positions thereof from time to time.

According to a further proposal of the present invention, there is provided means for displacing the dressing tool about the pivot axis between the aforementioned two positions which are angularly spaced from each other by 180 degrees. In these circumstances, it is particularly advantageous when the axis of the grinding wheel encloses the same acute angle with the axis of rotation of the dressing tool in each of the positions of the latter. Such acute angle may preferably amount to approximately 1 degree. When this expedient is resorted to, it is possible to obtain point contact of the treating surface of the dressing tool with the grinding wheel even at the end faces of the latter, and to achieve even a certain degree of undercutting, if such is desired.

It is further advantageous when the dressing tool is disk shaped, and when it has an asymmetric configuration as considered in any radial plane thereof. This expedient renders it possible to so shape the tool as to be relatively stable, and also to use the tool for treating relatively narrow and/or deep grooves which would not be possible if the tool were symmetrical.

The novel features which are considered as characteristic of the invention are set forth in particular in the appended claims. The improved grinding machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 2:
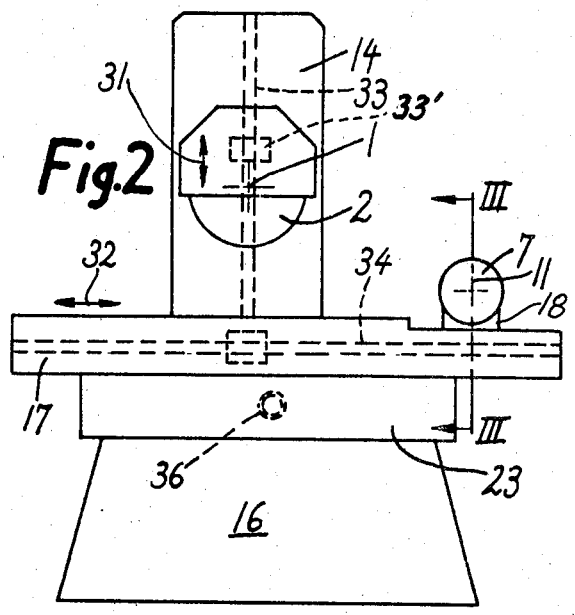
FIG. 2 is a side elevational view of a grinding machine which is equipped with the dressing tool of FIG. 1.

The grinding machine 16 of FIG. 2 comprises a grinding wheel 2 which is rotable about a horizontal axis 1 and is mounted on a support 14. The peripheral or working surface 3 of the grinding wheel 2 is treated by a rotary dressing tool 7 which is located at a level below the grinding wheel and is driven to rotate about an axis 6. The means for rotating the dressing tool 7 comprises a motor 4. The working surface 3 of the grinding wheel 2 has circumferential grooves (see particularly FIG. 1) one of which is flanked by faces 8, 9 and the other of which is flanked in part by a face 9' which is similar to but spaced apart from the face 9, as considered in the direction of the axis 1. The reference character 8' denotes a further portion of the working surface 3. The faces 8 and 9 face each other in the right-hand groove as considered in the axial direction of the working surface 3, shown in FIG. 1. The treatment of the face 8 requires a first orientation of the dressing tool 7, and the treatment of the face 9 requires a different second orientation of the dressing tool. The illustrated dressing tool 7 is asymmetric and is pivotable, about an axis 11, between two preferred positions I and II in which its merginal portion respectively treats the surfaces 9 and 8. The pivot axis 11 of the dressing tool 7 intersects the axis 6 and the tool must be pivoted about the axis 11 through 180 degrees in order to assume the preferred position I or II. In each of the two preferred positions I and II of the tool 7, the axes 1 and 6 make a relatively small acute angle alpha, e.g., an angle of one degree. For the sake of clarity, the angle alpha is exaggerated in each of FIGS. 1 and 3.

Figure 3:
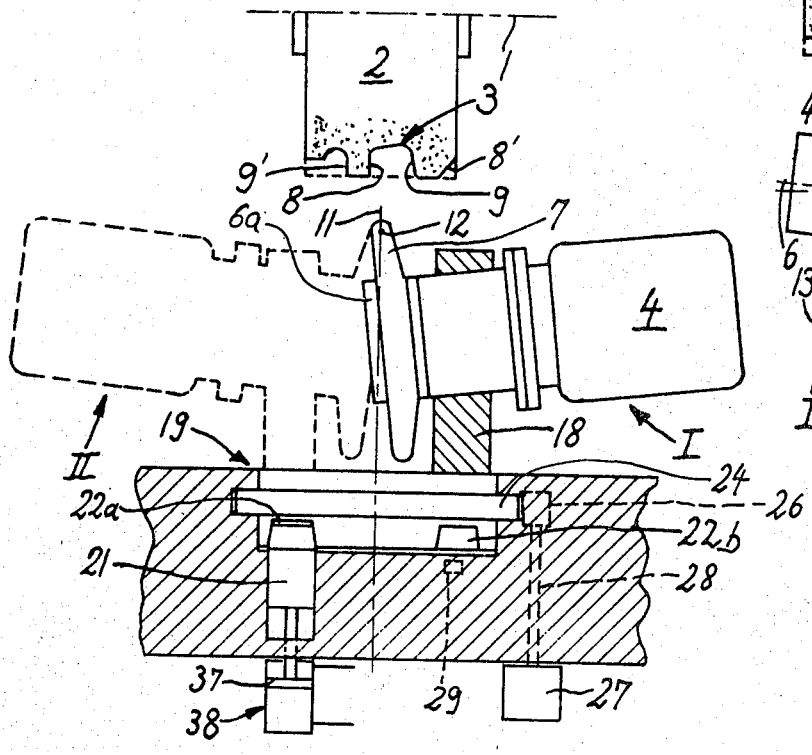
FIG. 3 is an enlarged sectional view as seen in the direction of arrows from the line III—III of FIG. 2.

As seen in FIG. 3, centers 12 of curvature of a convex peripheral surface 13 of the dressing tool 7 in the region of contact between the wheel 2 and the wheel 7 are located on the pivot axis 11. In other words, the inner ends of successive radial of curvature of the peripheral surface 13 in the region where the tool 7 treats the working surface 3 are located in a plane including the axis 11.

When the tool 7 is pivoted to the preferred position I, the surface 13 treats the surface 9 or 9'. When the tool 7 is thereupon pivoted to the position II, it is ready to treat the surface 8. The additional surfaces between the surfaces 8, 9, 8' or the surface adjacent to the surface 9' can be treated while the tool 7 assumes either one of the positions I or II. The just-mentioned additional surfaces may be concave, convex or partly concave and partly convex. The peripheral surface 13 can also serve to treat cylindrical portions of the working surface 3.

Prior to privoting of the dressing tool 7 about the axis 11, the tool 7 is moved radially of and away from the grinding wheel 2 and/or vice versa so as to avoid collision during actual turning from the preferred position I to the preferred position II or back to the position I. Once the tool 7 has been pivoted, it is moved radially toward the wheel 2 and/or vice versa. In the alternative, the dressing tool 7 may be moved axially relative to the grinding wheel 2 or even substantially tangentially thereof. All of these possibilities will be discussed in greater detail as this discussion proceeds.

Referring now to FIG. 2, it may be seen that the grinding wheel 2 is movable relative to or with the support 14 in the directions indicated by a double-headed arrow 31. This movement can be achieved by means of a conventional moving arrangement, such as by means of a rotatable externally threaded spindle 33 mounted in the support and cooperating, for instance, with an internally threaded follower which is connected to the grinding wheel 2 for joint movement in the direction of the arrow 31.

The grinding machine 16 which includes the support 14 is assumed to be a flat or profile grinding machine. This machine 16 further comprises a table or platform 17 for workpieces which are to be treated by the wheel 2. The table 17 is movable in the directions indicated by an arrow 32 and/or at right angles to such directions. Here again, the movement of the table 17 can be achieved in a conventional manner, such as by means of a spindle 34 or a spindle 36.

A shaft 6*a* (see FIG. 3) for the dresing tool 7 is driven by the rotor 4 and is journalled in a carrier member 18 which is secured to and extends upwardly from a turntable 19. The latter forms part of the means for indexing the tool 7 about the axis 11 between the positions I and II. The turntable 19 can be rotated by a gear 24 and is rotatably mounted in the table 17 or in a similar holder or base. The gear 24 meshes with a pinion 26. The pinion 26 can be rotated by an indexing motor 27 via a shaft 28, whereby the turntable 19 will move between its positions I and II.

The reference characters 22*a* and 22*b* denote two abutments, stops or detents which respectively serve to arrest the turntable 19, and thus the dressing tool 7, in the positions I (shown in FIG. 3 by solid lines) and II (shown in FIG. 3 by broken lines). The abutments 22*a*, 22*b* have been shown as recesses which receive the free end of a reciprocable pin 21 which is retractibly mounted in the aforementioned base (such as the table 17). For instance, a hydraulic or pneumatic cylinder and piston unit including a piston 37 reciprocably mounted in a cylinder 38 may be used to move the pin 21 into and out of the recesses 22, 22*b*.

FIG. 2 further shows a carriage 23 which forms part of the machine 16 and is movable with or relative to the support 14. In order to lift the grinding wheel 2 to a level above the the dressing tool 7 so that the wheel 2 assumes its operative position for treatment of workpieces, the wheel 2 can be moved upwardly with or relative to the support 14 in the manner described above, or the carriage 23 can move in one of the directions indicated by the double-headed arrow 31. The support 14 may share the movements of the carriage 23 with respect to the housing or frame of the machine 16 (then, the table 17 will remain stationary). The dressing tool 7 is pivoted to the position I or II subsequent to disengagement of its surface 13 from the working surface 3.

Figure 1:
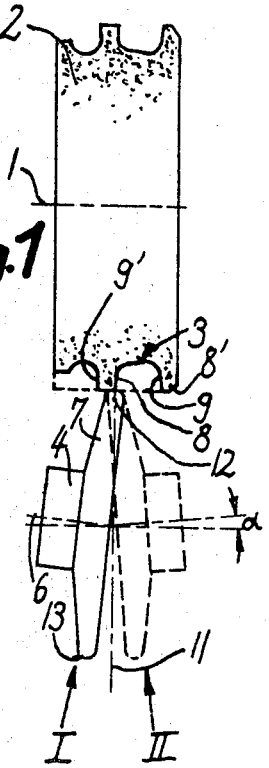
FIG. 1 is a schematic end elevational view of a grinding wheel with a profiled working surface and of a dressing tool which is shown in two preferred positions.

Having so described the construction of the arrangement of the present invention as illustrated in FIGS. 1 to 3, the operation thereof will be now briefly discussed. It will be assumed that the arrangement is a permanent constituent of the grinding machine 16, that is, that the turntable 19 is supported directly on or in the table 17 of the machine 16, as illustrated in FIG. 2. However, it will be appreciated that the same conditions will exist should the turntable be mounted in a self-contained unit which would be mounted on the table 17, for instance, in the illustrated position.

During the normal operation, the grinding wheel 2 operates on workpieces which are supported on the table 17. As customary, the table 17 is moved by the spindle 34 and/or 36 so that the workpieces are moved relative to the grinding wheel 2 in a horizontal plane. Simultaneously, or independently, the spindle 33 may move the grinding wheel 2 in the vertical direction, such as for approaching and moving away from the workpieces or, for instance, incrementally during the grinding operation. Either one of these movements may be used either only for properly positioning the grinding wheel relative to the workpieces, or for achieving relative movement between the workpieces and the grinding wheel 2 during the grinding operation. All of this is completely conventional so that it need not be discussed in any greater detail. However, it is to be mentioned that, if the dressing tool 7 is incorporated in or permanently affixed to the table 17, the movements (especially in the direction of the arrow 32) are so limited that the dressing tool 7 never reaches or approaches the grinding wheel 2 while the same is used for grinding or otherwise treating the workpieces.

Now, from time to time, it is necessary to dress or otherwise treat the grinding wheel 2, particularly to restore its desired profile or to remove the outermost layer of the surface 3 which may have lost its abrasive properties while grinding the workpieces. When this is to be done, the normal operation of the machine is discontinued, so that the table 17 can be moved by the spindle 34 in such a manner that the dressing tool 7 becomes situated underneath the grinding wheel 2, preferably so that the axes 1 (of the grinding wheel 2) and 6 (of the dressing tool 7) are located in the same vertical plane (in position I or II of the dressing tool 2). It is best when the spindle 33 is used to lift the grinding wheel 2 while the dressing tool 7 is being introduced underneath the same, in order to avoid the possibility of collision. Once the dressing tool 7 is properly positioned underneath the grinding wheel 2 (which includes the possibility that it is axially spaced therefrom), the grinding wheel 2 may be lowered to the desired extent, and the dressing or profiling operation may be commenced.

As mentioned above, the dressing tool 7 has to be in one of its positions I and II before the commencement of the dressing or profiling operation. To achieve this (if not already achieved before), the motor 27 is energized (if need be, after the pin 21 has been retracted from one of the recesses 22*a*, 22*b* by the unit 37, 38), so that the pinion 26, due to its meshing with the gear 24, rotates the turntable 19 into, say, position I. When this position is reached, the free end of the pin 21 enters the recess 22*a* for position I, and arrests the turntable 19 and, consequently, also the tool 7 in this position. The tool 7 is ready to commence operation on, for example, the bevelled face 8' of the surface 3.

During this dressing or profiling operation, the spindles 36 and 33 are so operated in correlation with the surface 13 that the tool 7 follows the desired course or contour of this face 8'. The controlling arrangement for achieving this purpose is entirely conventional and may be constituted by a programmable control of the machine 16. The same procedure is followed for dressing the face which extends between the faces 8' and 9, except that the spindle 33 does not move under these circumstances. However, for operating on the surface 9, it is necessary to move the dressing tool 7 into its position II to achieve best results. For this, the pin 21 is retracted from the recess 22*a*, the motor 27 energized to rotate the turntable 19 through 180 degrees about the axis 11, whereupon the pin 21 is introduced into the recess 22*b* to arrest the turntable 19 in the position II. Because of the location of the inner end of the curved portion of the surface 13 at the axis 11, the operation of the tool 7 can be continued, without any overlap of or gap between the zones of the surface 3 which are treated in the positions I and II, respectively. The operation of the tool 7 is continued in a similar manner, with a periodic switching between the positions I and II, as needed for proper treatment of the face 9' and the additional faces intermediate or adjacent to these numbered faces.

During the switching of the turntable 19 and the tool 7 mounted thereon between the positions I and II, it may be desirable or even necessary to retract the grinding wheel 2 relative to the tool 7, especially when the switch is to take place when the surface 13 of the tool 7 acts on the bottom of any groove or the like. This can be achieved, for instance, by appropriately moving the spindle 33 prior to the switch, and by turning the spindle into its previous position upon the termination of the switch. Even under these circumstances, the treatment will restart where the previous treatment left off. Another possibility is to energize the spindle 34 to move the tool 7 from underneath the grinding wheel 2 into a position where there will be no interference between the grinding wheel 7 and the dressing tool 2 during the movement of the latter between its positions I and II. However, when the groove is wide enough, it may be possible to energize the spindle 36 to center the tool 7 within the groove and to rotate the turntable 19 in this position, without interference of the disk-shaped tool 7 with the grinding wheel 2.

Once the entire surface 3, or that portion thereof which has undergone pronounced wear, has been treated in the above manner, the table 17 is returned into its original illustrated position (FIG. 2) and the machine is ready for normal operation. Of course, when the arrangement of the present invention is constructed as a self-contained unit, it can be removed from the table 17 and stored elsewhere until next use.

The disk-shaped tool 7 may be symmetrical, that is, its periphery may be flanked by two portions which enclose the same angle with the central plane of the tool 7. However, the tool 7 is preferably asymmetrical, since this renders it possible to penetrate into deeper and/or narrower grooves of the grinding wheel 2.

Figure 4:
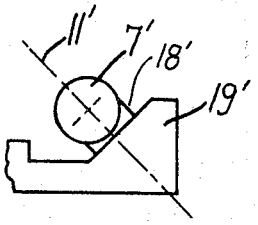
FIG. 4 illustrates a portion of a grinding machine with a differently mounted dressing tool.

FIG. 4 shows a portion of a modified grinding machine. The bearing member 18' for the dressing tool 7' is pivotable about an axis 11' which is inclined so as to make an acute angle with a horizontal plane. The reference character 19' designates the turntable for the tool 7'. Thus, the inclination of the pivot axis 11' with respect to the horizontal is different from the inclination shown in FIG. 1. However, relative to the axis 1 of the grinding wheel (not shown in FIG. 4), such inclination remains unchanged.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. An arrangement for multi-stage treatment of profiled working surfaces of grinding wheels or the like, comprising a rotary dressing tool having a treating surface with a profile deviating from the profile of the working surface of the grinding wheel and contacting such working surface during the treatment of the latter; means for mounting said dressing tool for angular displacement through an angle greatly exceeding 90 degrees relative to said grinding wheel about a pivot axis which intersects said treating surface to thereby enable said tool to treat different portions of the profiled working surfaces of grinding wheels of the type wherein at least one first portion of the working surface is accessible to the treating surface only prior to and at least one second portion of the same working surface is accessible to the treating surface only after angular displacement of the dressing tool through an angle exceeding 90 degrees; and means for displacing said dressing tool about said axis between only two positions.

2. An arrangement as defined in claim 1, wherein said pivot axis is located in a plane which is normal to the axis of said grinding wheel.

3. An arrangement as defined in claim 2, wherein said mounting means also mounts said dressing tool for rotation about a second axis and said pivot axis intersects said second axis.

4. An arrangement as defined in claim 3, wherein said positions are spaced through 180 degrees from one another and the axis of the grinding wheel makes an acute angle with said second axis in each of said positions.

5. An arrangement as defined in claim 4, wherein said acute angle is about 1 degree.

6. An arrangement as defined in claim 3, wherein said dressing tool is disk shaped.

7. An arrangement as defined in claim 6, wherein said disk shaped dressing tool has an asymmetric configuration, as considered in a radial plane.

8. An arrangement as defined in claim 1, wherein said treating surface is convex and has an inner end located at the intersection of said pivot axis with said treating surface.

9. An arrangement for treating rotary grinding wheels or the like, particularly for treating grinding wheels having profiled working surfaces, comprising a rotary dressing tool having a treating surface whose profile deviates from that of the working surface of the grinding wheel during treatment of the latter; and means for mounting said dressing tool for angular displacement through approximately 180 degrees relative to the grinding wheel between only two positions and about a pivot axis which intersects said treating surface to thereby enable said tool to treat different portions of profiled working surfaces of grinding wheels of the type wherein at least one first portion of the working surface is accessible to said treating surface only prior to and at least one second portion of the same working surface is accessible to said treating surface only after angular displacement of approximately 180 degrees, said pivot axis being located in a plane which is normal to the axis of the grinding wheel and said mounting means mounting said dressing tool for rotation about a second axis which intersects said pivot axis.

10. An arrangement for multi-stage treatment of profiled working surfaces of grinding wheels or the like, comprising a rotary dressing tool having a treating surface with a profile deviating from the profile of the working surface of the grinding wheel and contacting said working surface during the treatment of the latter, said dressing tool having an asymmetric configuration as considered in a radial plane; means for mounting said dressing tool for angular displacement between two positions through an angle of substantially 180 degrees relative to said grinding wheel about a pivot axis which intersects said treating surface to thereby enable said tool to treat different portions of the profiled working surfaces of grinding wheels of the type wherein at least one first portion of the working surface is accessible to the treating surface only prior to and at least one second portion of the same working surface is accessible to the treating surface only after angular displacement of the dressing tool through substantially 180 degrees; and means for displacing said dressing tool about said pivot axis only between said two positions.

* * * * *